US007627263B2

(12) United States Patent
Takishita

(10) Patent No.: US 7,627,263 B2
(45) Date of Patent: Dec. 1, 2009

(54) IMAGE FORMING APPARATUS INCLUDING A CLEANING WEB FOR REMOVING RESIDUAL TONER

(75) Inventor: Shigeki Takishita, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 11/694,256

(22) Filed: Mar. 30, 2007

(65) Prior Publication Data

US 2007/0230994 A1 Oct. 4, 2007

(30) Foreign Application Priority Data

Apr. 3, 2006 (JP) ..... 2006-101825

(51) Int. Cl.
*G03G 15/16* (2006.01)
*G03G 21/00* (2006.01)

(52) U.S. Cl. ..... 399/101; 399/345; 399/349

(58) Field of Classification Search ..... 399/101, 399/297, 345, 349
See application file for complete search history.

(56) References Cited

U.S. PATENT DOCUMENTS 5,559,593 A 9/1996 Yoshinaga et al.
5,619,746 A * 4/1997 Kubo et al. ..... 399/101 X
5,671,464 A * 9/1997 Kubota ..... 399/101
5,970,281 A * 10/1999 Park ..... 399/101
5,983,050 A * 11/1999 Takekoshi et al. ..... 399/349 X
6,522,856 B2 2/2003 Nakayama ..... 399/297
6,907,217 B2 * 6/2005 Hattori ..... 399/345 X
7,251,430 B2 * 7/2007 Nishikawa ..... 399/101 X

FOREIGN PATENT DOCUMENTS

JP 10-149033 A2 6/1998
JP 2001-305878 A2 11/2001
JP 3236442 B 12/2001
JP 2002-207403 A2 7/2002

* cited by examiner

*Primary Examiner*—Sandra L Brase
(74) *Attorney, Agent, or Firm*—Fitzpatrick, Cella, Harper & Scinto

(57) ABSTRACT

The image forming apparatus of this invention includes an image bearing member which bears a toner image; a toner image forming device which forms a plurality of the toner images on the image bearing member continuously; a transfer device which transfers the toner image on the image bearing member to a recording material; a cleaning web which wipes off toner remaining on the image bearing member after the toner image is transferred to the recording material; and a separating unit which separates the web from the image bearing member when the toner image forming means is forming a plurality of the toner images on the image bearing member continuously.

4 Claims, 5 Drawing Sheets

IMAGE FORMING APPARATUS INCLUDING A CLEANING WEB FOR REMOVING RESIDUAL TONER

BACKGROUND OF THE INVENTION

1. Field of the Invention

The present invention relates to an image forming apparatus using an electrophotographic system and more particularly to an image forming apparatus having a member for wiping off toner on an intermediate transfer member.

2. Description of the Related Art

An image forming apparatus for forming an image on a recording material using an electrophotographic system employs a method of transferring an image transferred once to an intermediate transfer member to a recording material in order to form a high quality image corresponding to a variety of the recording materials in terms of size and material.

As a method for removing toner left on the intermediate transfer member after the toner image is transferred to the recording material, a method of bringing a blade shaped member into a contact with the intermediate member by applying pressure and a method of bringing a brush member applied with a voltage into a contact with the intermediate transfer member by applying pressure while rotating it are known.

However, sometimes the above-mentioned methods cannot sufficiently remove a small-particle substance, such as an additive contained in toner. Thus, a method of bringing unwoven fabric into a contact with the intermediate transfer member by applying pressure so as to wipe off remaining toner has been employed in recent years.

However, according to the method of wiping off the toner, if removal of toner is continued by forming the toner image on the intermediate transfer member repeatedly, toner is accumulated in a contact portion between the wiping member and the intermediate transfer member. Then, this accumulated toner passes the contact portion, thereby causing cleaning failure.

SUMMARY OF THE INVENTION

An object of the present invention is to prevent the occurrence of cleaning failure in an image forming apparatus for removing toner on the intermediate transfer member using the wiping member.

Another object of the present invention is to provide an image forming apparatus including: an image bearing member which bears a toner image; a toner image forming means which forms a plurality of the toner images on the image bearing member continuously; a transfer means which transfers the toner image on the image bearing member to a recording material; a cleaning web which wipes off toner remaining on the image bearing member after the toner image is transferred to the recording material at a cleaning position; and a separating unit which separates the cleaning web from the image bearing member when an inter-image area of the image bearing member exists at the cleaning position, during which the toner image forming means is forming a plurality of the toner images on the image bearing member continuously.

DESCRIPTION OF THE EMBODIMENTS

Hereinafter, an exemplary embodiment of the image forming apparatus of the present invention will be described in detail with reference to the accompanying drawings.

Figure 1:
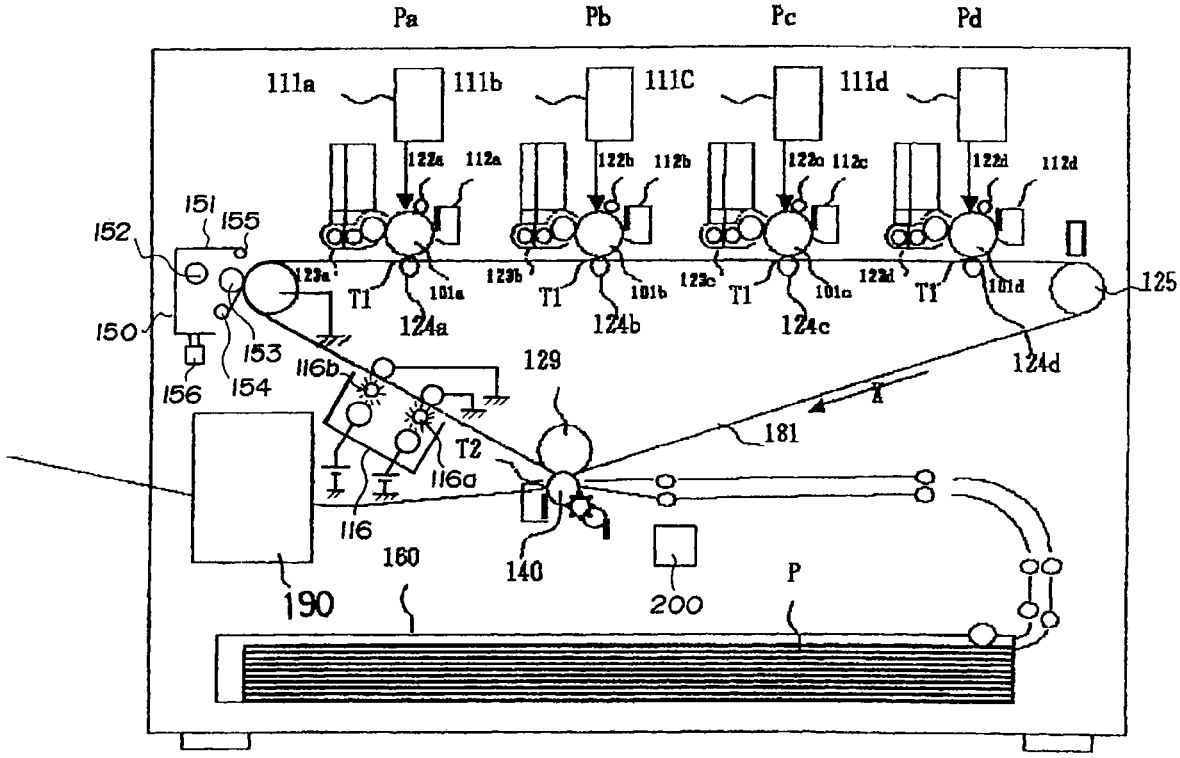
FIG. 1 is a diagram showing an image forming apparatus loaded with a cleaning device according to an embodiment of the present invention.
Figure 2:
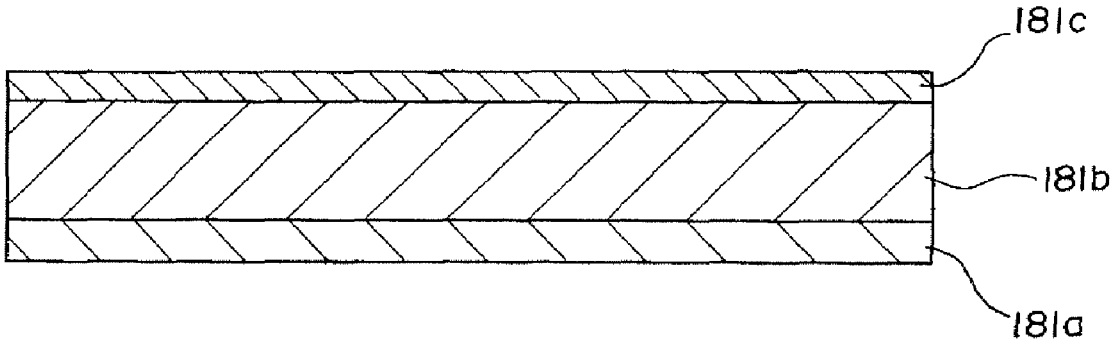
FIG. 2 is a sectional view showing the lamination structure of an elastic belt (intermediate transfer belt) according to the embodiment.

FIG. 1 shows a tandem-type image forming apparatus having four photosensitive drums as electrostatic latent image bearing members corresponding to four colors, yellow (Y), magenta (M), cyan (C) and black (K). An endless elastic belt (image bearing member) 181, which is an intermediate transfer member equipped on this apparatus main body, is stretched between a drive roller 125, a tension roller 126 and a backup roller 129. Using the elastic belt 181 as the intermediate transfer member enables a reduction of so-called hollow defects in which part of the toner image is left on the intermediate transfer member when the toner image on the intermediate transfer member is transferred to a recording material. As shown in FIG. 2, the elastic belt 181 is constituted of a three-layer lamination of a resin layer 181*a*, an elastic layer 181*b* and a surface layer 181*c* in order.

Four image forming portions Pa, Pb, Pc, Pd each having the same structure are disposed in line corresponding to the aforementioned colors Y, M, C, K along the horizontal portion of the elastic belt 181. The image forming portion Pa will be described as a representation of the four image forming portions. In the meantime, the other three image forming portions Pb, Pc, Pd are also denoted by reference numerals (112*b*, 112*c*, 112*d*; 122*b*, 122*c*; 122*d*; and 123*b*, 123*c*, 123*d*) corresponding to the parts 112*a*, 122*a*, and 123*a*, respectively of the image forming portion Pa.

The image forming portion (toner image forming means) Pa includes a photosensitive drum (electrostatic image bearing member) 101*a* which receives a rotation force from a motor which is a rotation drive source of the apparatus main body and is supported rotatably.

A primary charger 122*a*, a development device 123*a*, a photosensitive drum cleaning device (electrostatic image bearing member cleaning device) 112*a*, and a primary transfer roller (primary transfer member) 124*a* are disposed around this photosensitive drum 101*a* as a process unit which acts on the photosensitive drum 101*a*. Assume that the development device 123*a* accommodates toner of yellow color (Y). The toner is composed of coloration particles made of polyester or the like and an additive such as titanium oxide for adjusting the charging characteristic of is the coloration particle particles.

The surface of the photosensitive drum 101*a* is uniformly charged by being applied with charging bias voltage by a primary charger 122*a*. An image signal by the Y component color of an original is projected to the photosensitive drum 101*a* via a rotary polygon mirror from an exposure device 11*a* such as a laser scanner so as to form an electrostatic latent image (electrostatic image). Subsequently, Y color toner having a negative polarity is supplied from the development device 123*a* so that electrostatic latent image is developed as a Y color toner image. With a rotation of the photosensitive drum 101*a*, this Y color toner image reaches a primary transfer portion (toner image formation area) in which both the photosensitive drum 101*a* and the elastic belt 181 make contact with each other. A primary transfer bias voltage having a positive polarity is applied to the primary transfer roller 124*a* which is a primary transfer unit (primary transfer means) so that the Y color toner image is transferred to the elastic belt 181.

The elastic belt 181 bearing this Y color toner image is conveyed to the image forming portion Pb on a next stage. By that time, on the image forming portion Pb, an M color toner image formed on the photosensitive drum 101*b* is transferred to the Y color toner image in the same manner and method. As the elastic belt 181 progresses to the image forming portions Pc, Pd along a direction indicated by an arrow, the C color toner image and the K color toner image are transferred in a superimposed manner onto the aforementioned toner image in each transfer portion T1. In the meantime, the M color toner, the C color toner and the K color toner are also charged with a negative polarity. By this time, a recording material P sent from a sheet cassette 160 reaches a secondary transfer portion T2 and the four color toner images are transferred to the recording material P by a secondary transfer bias voltage of a positive polarity applied to the secondary transfer device (secondary transfer means) 140. The image forming apparatus of this embodiment repeats the above-described process so that a plurality of toner images are formed on the elastic belt 181 continuously. Then, these toner images are secondarily transferred to the recording material P continuously.

The color image primarily transferred to the elastic belt 181 at the primary transfer portion T1 is secondarily transferred to the recording material P at the secondary transfer portion T2 at which the elastic belt 181 and the secondary transfer roller 140 make contact with each other. With the secondary transfer roller 140 connected to a transfer bias power supply (not shown), the secondary transfer is carried out when the secondary transfer bias voltage having a positive polarity is applied to the secondary transfer roller 140. The sheet P, after the four toner images, Y, M, C, K are transferred, is sent to a fixing portion 190 so that the toner images are fixed to the recording material P with heat and pressure. Any remaining toner on the photosensitive drum 101*a*, which fails to be transferred at the primary transfer portion T, is removed by cleaning by a photosensitive drum cleaning device 112*a*.

Figure 3:
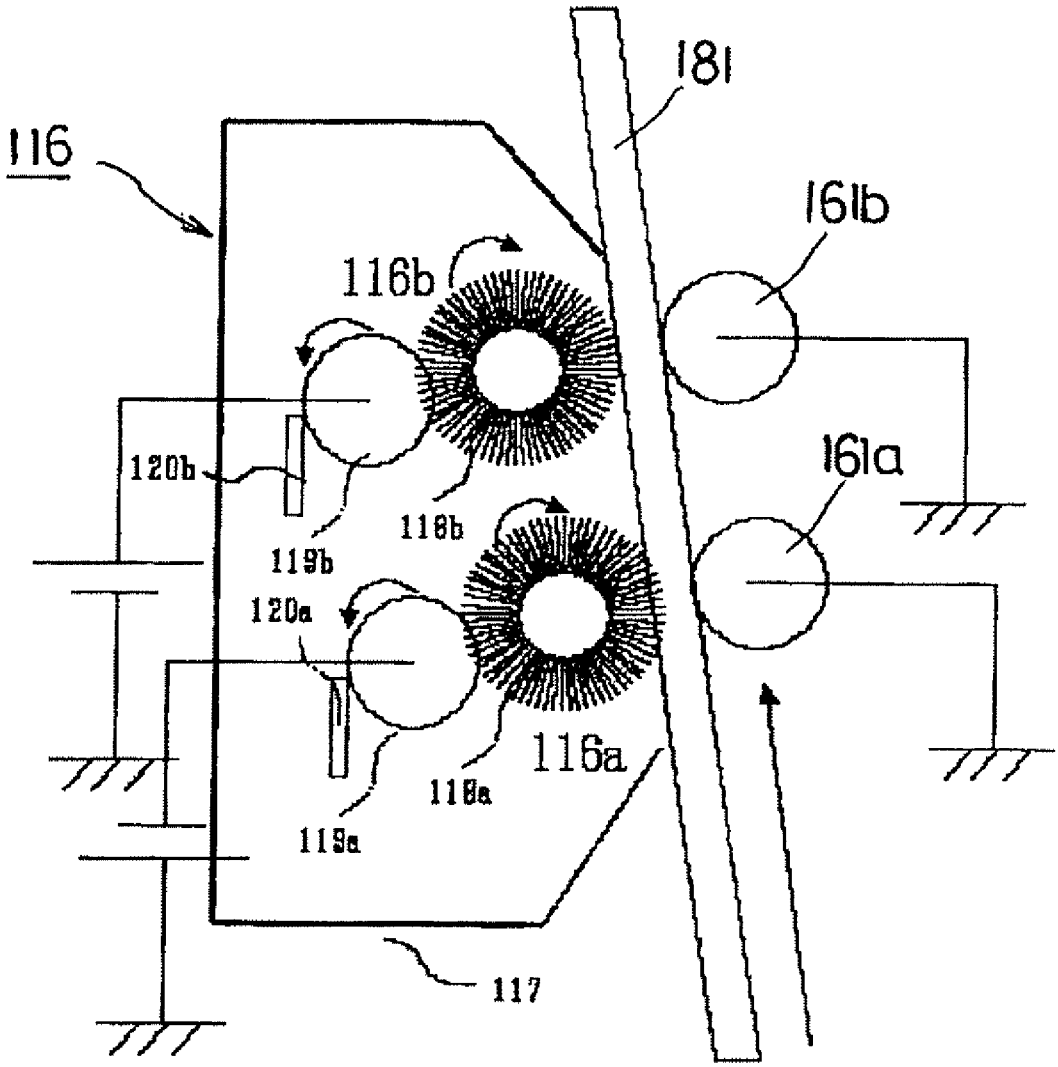
FIG. 3 is a diagram showing a first cleaning device of fur brush type of the embodiment.
Figure 4:
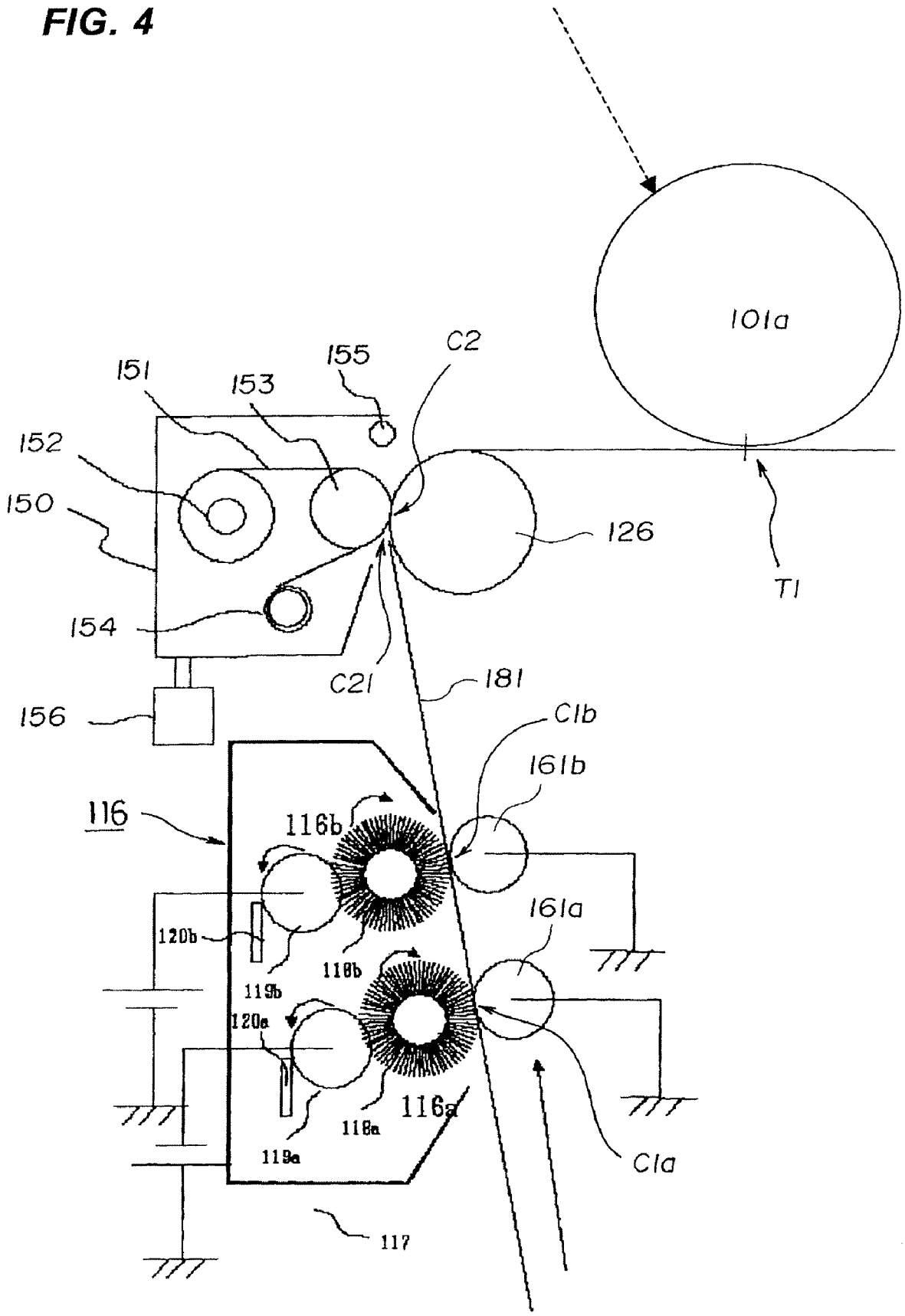
FIG. 4 is a diagram showing a second cleaning device of web type in addition to the first cleaning device.

The remaining toner on the elastic belt 181, which fails to be transferred at the secondary transfer portion T2, is removed with the first cleaning device 116 shown in FIGS. 3 and 4. In this embodiment, the first cleaning device 116 is constituted of two fur brush mechanisms 116*a*, 116*b*.

Further, metal rollers 119*a*, 119*b* made of aluminum, whose surface is subjected to hard alumite treatment, making contact with the fur brushes 118*a*, 118*b* are disposed within the apparatus housing 117. The metal rollers 119*a*, 119*b* are disposed with the invasion amount of about 1.0 mm with respect to the fur brushes 118*a*, 118*b* and rotated at a rate equal to the fur brushes 118*a*, 118*b* in the direction indicated by an arrow. Further, blades 120*a*, 120*b*, which make contact with the metal rollers 119*a*, 119*b*, are provided and these blades are formed of urethane rubber and disposed so as to keep contact with the metal rollers 119*a*, 119*b* with the invasion amount of 1.0 mm with respect thereto.

The first cleaning device 116 is constituted of the above-mentioned members. Pressing rollers 161*a*, 161*b* are disposed in positions opposing the fur brushes 118*a*, 118*b* across the elastic belt 181 so that the elastic belt 181 is pressed against the fur brushes 118*a*, 118*b* with an appropriate pressing force. The pressing rollers 161*a*, 161*b* are electrically grounded.

Therefore, any remaining toner on the endless elastic belt 181 serving as an image bearing member, which fails to be transferred thereto, is removed by the first cleaning device 116 as follows.

A voltage of −700 V (with respect to the ground) is applied from a power supply (not shown) to the metal roller 119*a* in one fur brush mechanism 116*a* located at the upstream side in a direction in which the elastic belt 181 is rotated. When the voltage is applied to the metal roller 119*a*, cleaning current flows between the metal roller 119*a* and the pressing roller 116*a*. Toner having a positive polarity on the elastic belt 181 is collected by the fur brush 118*a* in a cleaning area C1*a* in which the fur brush 118*a* makes contact with the elastic belt 181. The toner collected by the fur brush 118*a* is moved to the metal roller 119*a* by electrostatic force and scraped off by a blade 120*a* so that it is collected. Further, a voltage of +700 is applied to the metal roller 119*b* in the fur brush mechanism 116*b* located downstream. When the voltage is applied to the metal roller 119*b*, cleaning current flows between the metal roller 119*b* and the pressing roller 116*b*. The toner having a negative polarity on the elastic belt 181 is collected by the fur brush 118*b* in cleaning area C1*b* in which the fur brush 118*b* makes contact with the elastic belt 181. The toner collected by the fur brush 118*b* is moved to the metal roller 119*b* by an electrostatic force and scraped off by a blade 120*b* so that it is collected.

However, the small-particle substance contained in toner cannot be removed easily because it slips through the fur brushes 118*a*, 118*b*. Particularly, additives separated from the coloration particles adhere to the surface of the elastic belt 181 when a pressure applied portion of the secondary transfer portion T2 rubs the surface of the elastic belt 181. As a result, they cannot be removed easily with the fur brushes 118*a*, 118*b*.

As shown in FIG. 4, the toner is removed by wiping out the small-particle substance with a web 151 of the second cleaning device (cleaning member, cleaning web) 150 provided downstream of the first cleaning device 116.

In the second cleaning device 150, the unwoven fabric web 151 wound around a supply roller 152 in a roll-like form is fed out little by little and wound up by a winding roller 154 via a pressing roller 153 on which the web is wound around halfway, so that it is collected. The entire second cleaning device 150 is supported rotatably around a supporting pin 155 as a rotating fulcrum so that it can make contact with/separate from the elastic belt 181 by the action of a pressure releasing unit (separating unit) 156. The web 151 makes contact with the elastic belt 181 at a position in which it opposes the drive roller 126 so as to form the cleaning area C2 for collecting the toner. The winding roller (winding unit) 154 is driven by a rotation force of a drive unit (not shown) so as to wind up the web 151 and consequently, new web 151 is supplied successively to a contact portion at which the elastic belt 181 makes contact.

The web 151 makes contact with the surface of the elastic belt 181 by applying a total pressure of 2.0 kg thereto. As the material of the web 151, one or two or more selected from polyester, acrylic, vinylon, water-soluble vinylon, rayon, nylon, polypropylene, and cotton may be used. However, the material of the web 151 is not limited to the above-mentioned materials.

If the same surface of the web 151 is used for a long period of time, the web 151 is clogged so that the toner cannot be collected sufficiently.

Then, if the activation time for formation of the image elapses by a predetermined time of some interval, it is necessary to wind up the web 151 by a predetermined amount so as to renew the contact face with the elastic belt 181. In this embodiment, the timing and amount of winding up the web 151 are set to 2 mm each time when 25 pieces of A4 size sheet are passed. By feeding the web 151 to the contact portion with the elastic belt 181 at the above-described timing and amount, the small-particle substance of the toner that cannot be collected by the first cleaning device 116 can be removed excellently.

In this embodiment, an example that the second cleaning device 150 is equipped with unwoven belt-like web 151 is indicated. The collecting unit is not restricted to the belt-like web 151 as long as it can collect substances adhering to the surface of the belt into the interior by making contact with the elastic belt 181. For example, such a construction in which a web roller wound around the surface of the unwoven fabric web is rotated in a condition of making contact with the web roller may be adopted.

If removal of toner is continued, toner is accumulated on the upstream portion C21 in the cleaning area C2 of the web 151 as shown in FIG. 4. This accumulated toner is not removed even if the web 151 is wound up and remains on the upstream portion C21. Then, if the amount of the remaining toner becomes excessive, the toner slips through the cleaning area C2 thereby causing cleaning failure.

Then, in the image forming apparatus of this embodiment, the web 151 is separated from the elastic belt 181 at a predetermined timing so as to remove the accumulated toner.

When the web 151 is separated, the accumulated toner reaches the primary transfer portion accompanied with movement of the elastic belt 181. Then, when a voltage is applied to the primary transfer roller (124*a*, 124*b*, 124*c*, 124*d*), the accumulated toner is moved to the photosensitive drum 1 and collected by the photosensitive drum cleaning device 112*a*. When the accumulated toner reaches the primary transfer portion T1, the web 151 is separated so that the non-image area of the photosensitive drum 101*a* exists at the primary transfer portion T1.

As will be understood from above the foregoing discussion, the second cleaning device 150 of this embodiment feeds the web 151 little by little in an appropriate amount at a favorable timing and controls the contact/separation of the web 151 with respect to the elastic belt 181 alternately so as to remove the small-particle substance of the toner.

Next, the web control (separation control of the second cleaning device) for achieving the above-mentioned effect will be described with reference to the first to third embodiments. Although numerals for the dimensions are indicated, these are only for convenience of description and do not always represent the dimensions of an actual machine.

Web Control

Example 1

Figure 5:
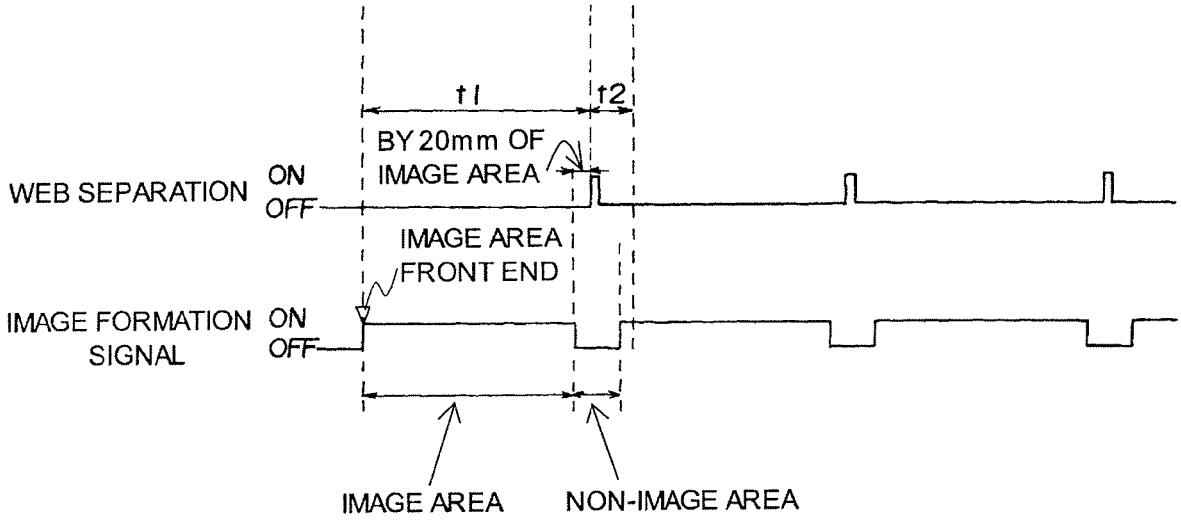
FIG. 5 is a web separation control time chart of the embodiment.

In FIG. 5, the control of the timing for separating the web 151 from the elastic belt 181 is executed as follows.

The distance between the central position of the cleaning area C1*b* of the fur brush 118*b* and the upstream portion C21 of the cleaning area C2 of the web 151 in the moving direction of the elastic belt 181 is set to 50 mm.

Likewise, the distance between the upstream portion C21 of the cleaning area C2 of the web 151 and the central position of the primary transfer portion T1 in which the photosensitive drum 101*a* makes contact with the elastic belt 181 in the moving direction of the elastic belt 181 is set to 97 mm. The distance from an exposure position on the photosensitive drum 101*a* to the center of the primary transfer portion T1 in the rotating direction of the photosensitive drum 101*a* is set to 117 mm. The circumferential velocity of the photosensitive drum 101*a* and the elastic belt 181 is set to 300 mm/sec.

The time in which the surface of the photosensitive drum 101*a* is moved over a distance of [length of image area Li+20 mm] is assumed to be t1. Further, time in which the photosensitive drum 101*a* is moved over length Ln of the non-image area of the photosensitive drum 101*a* is assumed to be t2.

As shown in FIG. 5, the web 151 is separated in a period from t1 to t2 since an image formation signal of an image area front end is outputted. As a consequence, when the accumulated toner is carried by the elastic belt 181 and reaches the primary transfer portion T1, it makes contact with the non-image area (inter-image area) of the photosensitive drum 101*a*. The separating operation of the web 151 is carried out when the non-image area of the elastic belt 181 exists in the cleaning area C2 of the web 151. The separated web 151 comes into contact with the elastic belt 181 by the time when a next image area reaches the cleaning area C2 to prepare for the removal activity.

As shown in FIG. 5, the web 151 is separated in a period from t1 to t2 since an image formation signal of an image area front end is outputted. As a consequence, when the accumulated toner is carried by the elastic belt 181 and reaches the primary transfer portion T1, it makes contact with the non-image area (inter-image area) of the photosensitive drum 1. The separating operation of the web 151 is carried out when the non-image area of the elastic belt 181 exists in the cleaning area C2 of the web 151. The separated web 151 comes into contact with the elastic belt 181 by the time when a next image area reaches the cleaning area C2 to prepare for the removal activity.

In this embodiment, the image area length Li is 206 mm and the non-image area length Ln is 50 mm. Thus, $$t1=(206\text{ mm}+20\text{ mm})/300\text{ mm/s}=0.75\text{ s}$$

$$t2=50\text{ mm}/300\text{ mm/s}=0.17\text{ s}$$

Because a voltage having a positive polarity is applied to the fur brush 118*b*, the accumulated toner is charged with a positive polarity. If a voltage having a negative polarity is applied to the primary transfer roller 124 when the accumulated toner reaches the primary transfer portion T1, the accumulated toner can be moved to the photosensitive drum 101*a*.

The toner can be prevented from being accumulated on the web to such an extent that it slips through, thereby preventing image failure due to slipping-through of the toner.

Web Control

Example 2

Although in this example, the separation timing of the web 151 is the same as the first embodiment, the web 151 is wound up when the web is separated, so that a new web face makes contact with the elastic belt 181. As a consequence, an amount of time in which the image formation is interrupted by the winding activity of the web 151 can be reduced.

Web Control

Example 3

In the above-described examples 1 and 2, the web 151 is separated based on a writing signal of the image area front end. In this example, the rear end of the sheet P is detected with a sheet detection sensor 200 disposed on the upstream side of the secondary transfer portion T2 in the moving direction of the sheet.

The web 151 is kept separated from the elastic belt 181 in a period from when the detection signal of the sheet detecting sensor 200 is outputted to when the front end of a next image comes. The same effect as the first and second embodiments is obtained.

The respective units which constitute the image forming portion Pa will be described here.

The photosensitive drum 101*a* is constructed by coating the outer peripheral face of aluminum cylinder with an organic photoconductive layer (OPC). The photosensitive drum 101*a* is supported rotatably by a flange at both end portions and an end portion thereof receives a rotation force from a drive motor (not shown), so that the photosensitive drum is rotated in a counterclockwise direction. The primary charger 122*a* is formed as a conductive roller and by bringing the conductive roller into a contact with the surface of the photosensitive drum 101*a* and then applying charging bias voltage with a power supply (not shown), the surface of the photosensitive drum 101*a* is charged uniformly with negative polarity. The exposure device 11*a* is constructed of a LED array (not shown) with a polygon mirror (not shown) at its front end and controlled to light corresponding to an image signal by the drive circuit. The development device 123*a* includes a toner accommodation portion (not shown) which accommodates toners of respective colors, Y, M, C, K, each having a negative charging characteristic and a development roller, which is adjacent to the surface of the photosensitive drum 101*a*, is rotated by a drive portion (not shown) and perform developing by applying a development bias voltage with a development bias power supply (not shown). The toner accommodation portion accommodates toners of the respective colors Y, M, C, K in this order from the upstream side in the conveyance direction of a transfer material.

Transfer rollers 124*a*, 124*b*, 124*c*, 124*d* are arranged as transfer members on the inner side of the elastic belt 181 and keep contact with the elastic belt 181 opposing four photosensitive drums 101*a*, 101*b*, 101*c*, 101*d*. These transfer rollers 124*a*, 124*b*, 124*c*, 124*d* are connected to respective transfer bias power supplies. Respective color toner images having a negative polarity on the photosensitive drum 101 are transferred to the elastic belt 181 keeping contact with the photosensitive drum 101 successively by the electric field generated through voltage application to the transfer roller 124 so as to form a color image.

The respective layers (see FIG. 2) constituting the elastic belt 181 are composed of following materials. The resin layer 181*a* may use one or two kinds selected from a group consisting of polycarbonate, fluororesin (ETFE, PVDF), styrene base resins (polymer or copolymer containing styrene or styrene substitution) such as polystyrene, chloropolystyrene, poly-a-methylstyrene, styrene-butadiene copolymer, styrene-vinyl chloride copolymer, styrene-vinyl acetate copolymer, styrene-maleate copolymer, styrene-acrylic acid ester copolymer (styrene-methyl acrylate copolymer), styrene-ethyl acrylate copolymer, styrene-butyl acrylate copolymer, styrene-octyl acrylate copolymer and styrene-phenyl acrylate copolymer (styrene-methyl methacrylate copolymer, styrene-ethyl methacrylate copolymer, styrene-phenyl methacrylate copolymer), styrene-a-methyl chloroacrylate copolymer, styrene-acrylonitrile-acrylic acid ester copolymer, methyl methacrylic acid resin, butyl methacrylate resin, ethyl acrylate resin, butyl acrylate resin, modified acrylic resin (silicon modified acrylic resin, vinyl chloride resin modified acrylic resin, acrylic urethane resin), vinyl chloride resin, styrene-vinyl acetate copolymer, vinyl chloride-vinyl acetate copolymer, rosin modified maleate resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl butyral resin, polyamide resin, polyimide resin, modified poly phenylene oxide resin, modified polycarbonate and the like. However, the resin layer is not restricted to the above-mentioned materials.

The elastic material (elastic rubber, elastomer) which forms the elastic layer 181*b* may be composed of one or two or more kinds selected from a group consisting of butyl rubber, fluoro rubber, acrylic rubber, EPDM, NBR, acrylonitrile-butadiene-styrene rubber natural rubber, isopropylene rubber, styrene-butadiene rubber, butadiene rubber, ethylene-propylene rubber, ethylene-propylene terpolymer chloroprene rubber, chlorosulfonated polyethylene, chlorinated polyethylene, urethane rubber, syndiotactic 1,2-polybutadiene, epichlorohydrin rubber, silicone rubber, fluoro rubber, polysulfide rubber, polynorbornene rubber, hydrogenated nitrile rubber, thermoplastic elastomer (for example, polystyrene base, polyolefin base, polyvinyl chloride base, polyurethane base, polyamide base, polyurea, polyester base, fluororesin base). However, the elastic material is not restricted to the above-mentioned materials.

Although the material of the surface layer 181*c* is not particularly restricted, any material which intensifies the secondary transfer performance by reducing the adhesion of toner to the surface of the elastic belt 181 is demanded. It is permissible to use a kind of resin material such as polyurethane, polyester, epoxy resin or material composed of two or more kinds selected from elastic material (elastic rubber, elastomer), butyl rubber, fluoro rubber, acrylic rubber, EPDM, NBR, acrylonitrile-butadiene-styrene rubber natural rubber, isopropylene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, those materials reducing surface energy to intensify lubricating property. One or two kinds or more of powders or grains or particles each having different sizes, of, for example, fluoro resin, fluorine compound, carbon fluoride, titanium dioxide, silicone carbide may be used by dispersion.

A resistance value adjusting conductive agent is added to the resin layer 181*a* and the elastic layer 181*b*. Although this resistance value adjusting conductive agent is not particularly restricted, it may be metal powder such as carbon black, graphite, aluminum or nickel or conductive metal oxides such as tin oxide, titan oxide, antimony oxide, indium oxide, potassium titanate, antimony oxide-tin oxide complex oxide (ATO), indium oxide-tin oxide complex oxide (ITO), and the conductive metal oxide may be coated with insulating fine particles such as barium sulfate, magnesium silicate, calcium carbonate. The above-mentioned conductive agent is not particularly restricted.

To manufacture the elastic belt 181, a centrifugal molding method of forming a belt by pouring material into a rotating cylindrical mold and a spray coating method of forming thin film on the front surface are available. Further, dipping method of dipping a cylindrical mold into material solution and lifting up, pouring method of pouring into a gap between an inner mold and an outer mold, and a method of vulcanization polishing with a compound wound around a cylindrical mold are also available. However, the manufacturing method is not restricted to those ones but a plurality of the manufacturing methods may be combined.

Although the embodiment and the examples 1-3 have been described, other embodiments, application examples and modification examples and combinations thereof may be adopted as long as it is within the range not departing from the spirit of the present invention.

This application claims the benefit of priority from the prior Japanese Patent Application No. 2006-101825 filed on Apr. 3, 2006 the entire contents of which are incorporated by reference herein.

What is claimed is:

1. An image forming apparatus comprising:

an image bearing member which bears a toner image;

a toner image forming unit which forms a plurality of the toner images on the image bearing member continuously;

a transfer unit which transfers the toner images on the image bearing member to a recording material;

a cleaning web which wipes off toner remaining on the image bearing member after the toner images are transferred to the recording material at a cleaning position; and a contacting/separating unit which contacts the cleaning web to the image bearing member and separates the cleaning web from the image bearing member when an inter-image area of the image bearing member exists at the cleaning position, wherein during forming a plurality of the toner images on the image bearing member continuously, the contacting/separating unit separates the cleaning web from an image formed area of the image bearing member and brings the cleaning web into contact with a non-image formed area.

2. The image forming apparatus according to claim 1, further comprising a cleaning device on the image bearing member which collects toner on the image formed area of the image bearing member.

3. The image forming apparatus according to claim 1, wherein the cleaning web is reeled when the cleaning web is separated from the image formed area of the image bearing member.

4. The image forming apparatus according to claim 2, wherein the cleaning web is located in the downstream side of the cleaning device and in the upstream side of the toner image forming unit in a direction in which the image bearing member is rotated.

* * * * *